US009059541B2

(12) United States Patent
Huang et al.

(10) Patent No.: US 9,059,541 B2
(45) Date of Patent: Jun. 16, 2015

(54) ELECTRICAL CONNECTOR ASSEMBLY AND AN ELECTRONIC DEVICE INCORPORATING THE SAME

(75) Inventors: Ching-Ming Huang, Taipei (TW); Hsin Sheng, New Taipei (TW)

(73) Assignee: Quanta Computer Inc., Tao Yuan Shien (TW)

( * ) Notice: Subject to any disclaimer, the term of this patent is extended or adjusted under 35 U.S.C. 154(b) by 525 days.

(21) Appl. No.: 13/614,364

(22) Filed: Sep. 13, 2012

(65) Prior Publication Data

US 2013/0244452 A1 Sep. 19, 2013

(30) Foreign Application Priority Data

Mar. 16, 2012 (TW) ..... 101109188 A

(51) Int. Cl.

| | |
|---|---|
| ***H01R 29/00*** | (2006.01) |
| ***H01R 13/641*** | (2006.01) |
| ***H01R 13/66*** | (2006.01) |
| ***H01R 13/70*** | (2006.01) |
| ***H01R 13/648*** | (2006.01) |

(52) U.S. Cl.

CPC ..... *H01R 13/641* (2013.01); *H01R 13/66* (2013.01); *H01R 13/70* (2013.01); *H01R 13/648* (2013.01)

(58) Field of Classification Search

CPC ..... H01R 13/70

USPC ..... 307/116

See application file for complete search history.

(56) References Cited

U.S. PATENT DOCUMENTS

| | | | | |
|---|---|---|---|---|
| 4,245,270 | A * | 1/1981 | Busby | 361/58 |
| 5,077,675 | A * | 12/1991 | Tam | 361/19 |
| 5,272,584 | A * | 12/1993 | Austruy et al. | 361/58 |
| 5,384,492 | A * | 1/1995 | Carlson et al. | 307/147 |
| 5,432,916 | A * | 7/1995 | Hahn et al. | 710/302 |
| 5,754,797 | A * | 5/1998 | Takahashi | 710/302 |
| 5,758,102 | A * | 5/1998 | Carey et al. | 710/302 |
| 6,038,615 | A * | 3/2000 | Yamada et al. | 710/2 |
| 6,310,410 | B1 * | 10/2001 | Lin et al. | 307/119 |

* cited by examiner

*Primary Examiner* — Fritz M Fleming
(74) *Attorney, Agent, or Firm* — Brinks Gilson & Lione

(57) ABSTRACT

An electrical connector assembly to be connected to a first control circuit includes a first connector including a switch unit, a second control circuit, and a first contact unit, and a second connector including a detecting circuit and a second contact unit. When connecting the first and second connectors, the connector assembly is disposed sequentially in first and second states. In the second state, where contact pads of the first and second contact units are in respective electrical contacts such that a loop is formed for a trigger signal to be transmitted to the detecting circuit for the latter to generate a detecting signal to the second control circuit, when the first control circuit generates a control signal, the second control circuit controls the switch unit to switch to a conducting state to transmit an electrical power signal to the first control circuit.

13 Claims, 3 Drawing Sheets

ELECTRICAL CONNECTOR ASSEMBLY AND AN ELECTRONIC DEVICE INCORPORATING THE SAME

CROSS-REFERENCE TO RELATED APPLICATION

This application claims priority to Taiwanese Patent Application No. 101109188, filed on Mar. 16, 2012.

BACKGROUND OF THE INVENTION

1. Field of the Invention

The invention relates to an electronic device, more particularly to an electrical connector assembly and an electronic device incorporating the same and adapted for receiving an electrical power signal.

2. Description of the Related Art

A computer generally includes an electrical connector assembly to deliver external electrical power to operating components of the computer. A conventional electrical connector assembly includes a connector and a jack connector. The jack connector is disposed in the computer and is connected to an internal circuit of the computer. The connector can connect removably the jack connector to deliver external electrical power to the internal circuit of the computer via the jack connector. As technology continues to advance, the system design and operations of computers become more sophisticated, and when a computer receives an external power signal at an inappropriate time, malfunctions or even short circuits may occur. Moreover, if the user connects a connector to a jack connector inappropriately (e.g., connecting a pin of the connector that transmits power to a pin of the jack connector that is to be grounded, and connecting a pin of the connector that is to be grounded to a pin of the jack connector is to receive power), there may also be malfunctions or short circuits.

SUMMARY OF THE INVENTION

Therefore, an object of the present invention is to provide an electrical connector assembly and an electronic device incorporating the same to eliminate the aforesaid drawbacks of the prior art.

According to one aspect of the present invention, an electronic device adapted for receiving an electrical power signal includes a first control circuit capable of generating a control signal, and an electrical connector assembly. The electrical connector assembly includes a first connector and a second connector. The first connector includes a switch unit, a second control circuit, a first substrate and a first contact unit.

The first contact unit is disposed on the first substrate and includes a first electrical power contact pad, and two first detecting contact pads, two first control contact pads and two first grounding contact pads symmetrically arranged on opposite sides of the first electrical power contact pad. The first detecting contact pads are electrically connected to each other. The first grounding contact pads are grounded. The second control circuit is electrically connected to the first control contact pads. The switch unit has a first terminal adapted for receiving the electrical power signal, a second terminal connected electrically to the first electrical power contact pad, and a control terminal electrically connected to the second control circuit. The switch unit is controlled by the second control circuit to switch between a conducting state, where the first and second terminals are conducting, and a non-conducting state, where the first and second terminals are not-conducting.

The second connector includes a detecting circuit, a second substrate and a second contact unit. The second contact unit is disposed on the second substrate and includes a second electrical power contact pad, a second detecting contact pad and a third detecting contact pad symmetrically arranged on opposite sides of the second electrical power contact pad, a second control contact pad and a third control contact pad symmetrically arranged on the opposite sides of the second electrical power contact pad, and two second grounding contact pads symmetrically arranged on the opposite sides of the second electrical power contact pad. The second detecting contact pad is to receive a trigger signal. The second grounding contact pads are grounded. The second electrical power contact pad and the second control contact pad are electrically connected to the first control circuit. The detecting circuit is electrically connected to the third detecting contact pad and the third control contact pad.

In a process of connecting the first connector and the second connector, the electrical connector assembly is disposed sequentially in a first state and a second state.

In the first state, the first electrical power contact pad is in electrical contact with the second electrical power contact pad, the first grounding contact pads are respectively in electrical contact with the second grounding contact pads, and the first control contact pads are respectively in electrical contact with the second and third control contact pads, such that the second control circuit is electrically connected to the first control circuit and the detecting circuit.

In the second state, the first electrical power contact pad remains in electrical contact with the second electrical power contact pad, the first grounding contact pads respectively remain in electrical contact with the second grounding contact pads, and the first control contact pads respectively remain in electrical contact with the second and third control contact pads such that the second control circuit remains electrically connected to the first control circuit and the detecting circuit, and the second detecting contact pad forms a circuit loop with the first detecting contact pads and the third detecting contact pad such that the trigger signal is transmitted from the second detecting contact pad through the loop to the detecting circuit for the detecting circuit to generate a detecting signal based on the trigger signal and transmit the detecting signal to the second control circuit through the electrical contact between the third control contact pad and a respective one of the first control contact pads.

Preferably, when the electrical connector assembly is in the second state, and when the first control circuit generates the control signal, the second control circuit receives the control signal from the first control circuit through the electrical contact between the second control contact pad and a respective one of the first control contact pads, and controls the switch unit to switch from the non-conducting state to the conducting state based on the control signal and the detecting signal, wherein when the switch unit is in the conducting state, the electrical power signal is transmitted to the first control circuit through the electrical contact between the first and second electrical power contact pads.

Preferably, the trigger signal is a ground signal. The detecting circuit includes a first switch, a first resistor and a second resistor. The first resistor has a first terminal that is adapted for receiving a biasing voltage and a second terminal that is electrically connected to the third detecting contact pad. The second resistor has a first terminal that is electrically connected to the first terminal of the first resistor and a second terminal that is electrically connected to the third control contact pad. The first switch has a first terminal that is electrically connected to the second terminal of the second resistor, a second terminal that is grounded, and a control terminal that is electrically connected to the second terminal of the first resistor.

Preferably, when the electrical connector assembly is in the first state, the first and second terminals of the first switch are conducting.

Preferably, when the electrical connector assembly is in the second state, the first and second terminals of the first switch are non-conducting, and the detecting signal is generated at the first terminal of the first switch.

Preferably, the switch unit includes a second switch, a third switch, a third resistor and a fourth resistor. The third resistor has a first terminal that is electrically connected to the first terminal of the switch unit, and a second terminal. The fourth resistor has a first terminal that is electrically connected to the second terminal of the third resistor, and a second terminal. The second switch has a first terminal that is electrically connected to the second terminal of the switch unit, a second terminal that is electrically connected to the first terminal of the switch unit and a control terminal that is electrically connected to the second terminal of the third resistor. The third switch has a first terminal that is electrically connected to the second terminal of the fourth resistor, a second terminal that is grounded, and a control terminal that is electrically connected to the control terminal of the switch unit.

Preferably, when the electrical connector assembly is in the first state, the first and second terminal of each of the second and third switches are non-conducting.

Preferably, when the switch unit is in the conducting state, the first and second terminals of each of the second and third switches are conducting, such that the electrical power signal is transmitted to the first control circuit when the electrical connector assembly is in the second state and when the first control circuit generates the control signal.

Preferably, the second control circuit includes an AND gate that has two input terminals respectively and electrically connected to the first control contact pads, and an output terminal electrically connected to the control terminal of the switch unit.

Preferably, the first control circuit is further connected electrically to the detecting circuit for receiving the detecting signal therefrom.

Preferably, one of the first, second and third detecting contact pads has a length that is smaller than that of the first and second electrical power contact pads, the first, second and third control contact pads and the first and second grounding contact pads.

Preferably, the first switch includes a first transistor and a first diode. The first transistor has a drain, a source and a gate that are respectively and electrically connected to the first, second and control terminals of the first switch. The first diode has an anode and a cathode that are respectively and electrically connected to the second and first terminals of the first switch.

Preferably, the second switch includes a second transistor and a second diode. The second transistor has a drain, a source and a gate that are respectively and electrically connected to the first, second and control terminals of the second switch. The second diode has an anode and a cathode that are respectively and electrically connected to the first and second terminals of the second switch.

Preferably, the third switch includes a third transistor and a third diode. The third transistor has a drain, a source and a gate that are respectively and electrically connected to the first, second and control terminals of the third switch. The third diode has an anode and a cathode that are respectively and electrically connected to the second and first terminals of the third switch.

According to another aspect of the present invention, there is provided the aforesaid electrical connector assembly adapted for receiving an electrical power signal and transmitting the electrical power signal to a first control circuit.

The effect of this invention lies in that through the above-mentioned design of the first and second connectors, it can be ensured that the electrical power signal is transmitted to the first control circuit only when the electrical connector assembly is in the second state, and when the first control circuit signals the second control circuit with the control signal to control the switch unit to switch from to the conducting state, in order to prevent the first control circuit from malfunctioning or short circuiting. Moreover, through the symmetrical design of the first and second contact units, regardless of whether the first connector is connected to the second connector in the correct way or in the reversed way (i.e., the by flipping the first connector by 180 degrees about an axis extending from the first electrical power contact pad), the electrical connector assembly will not damage the first control circuit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
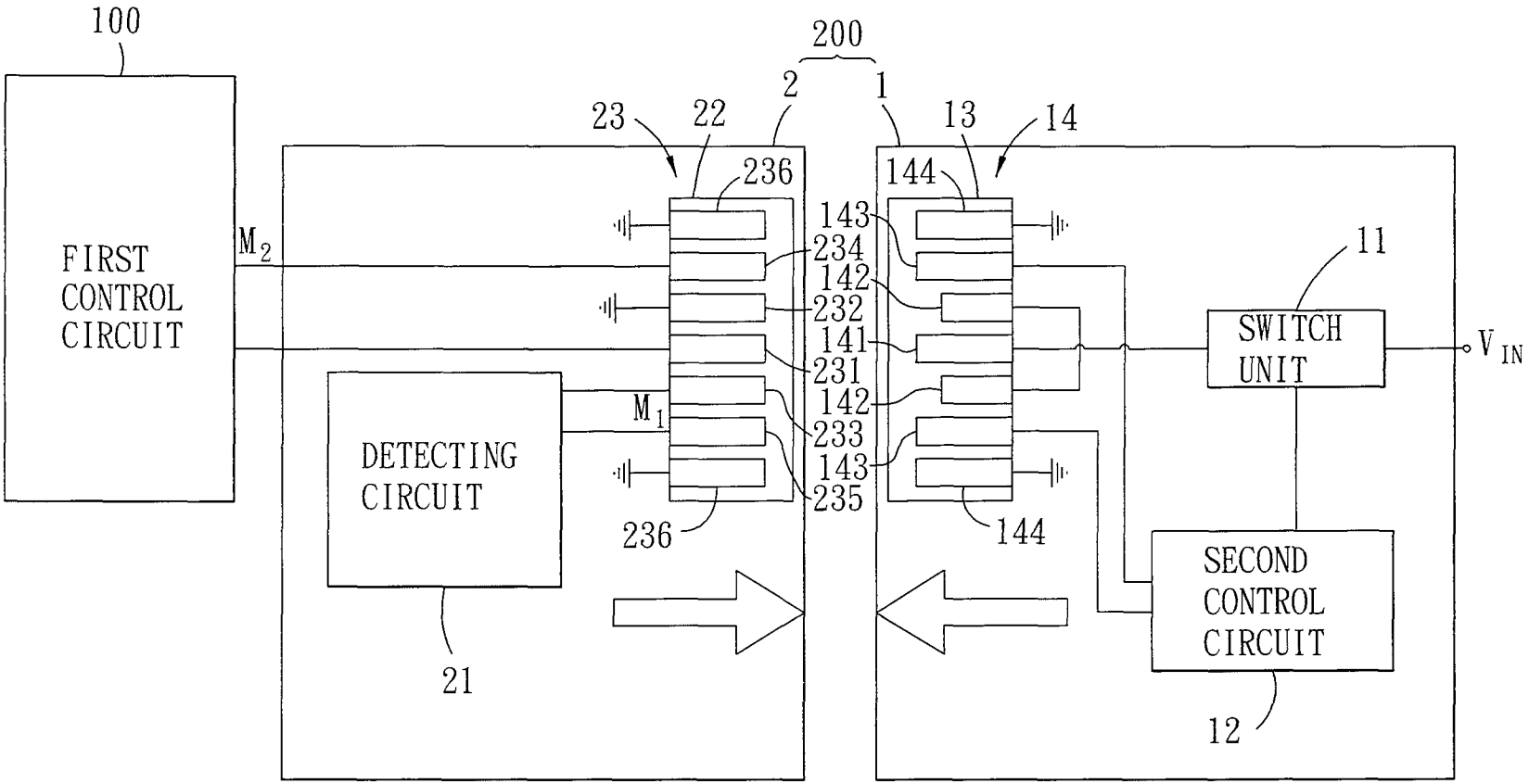
FIG. 1 is a schematic block diagram of an electrical device according to the first preferred embodiment of the present invention.

Before the present invention is described in greater detail, it should be noted that like elements are denoted by the same reference numerals throughout the disclosure.

Figure 2:
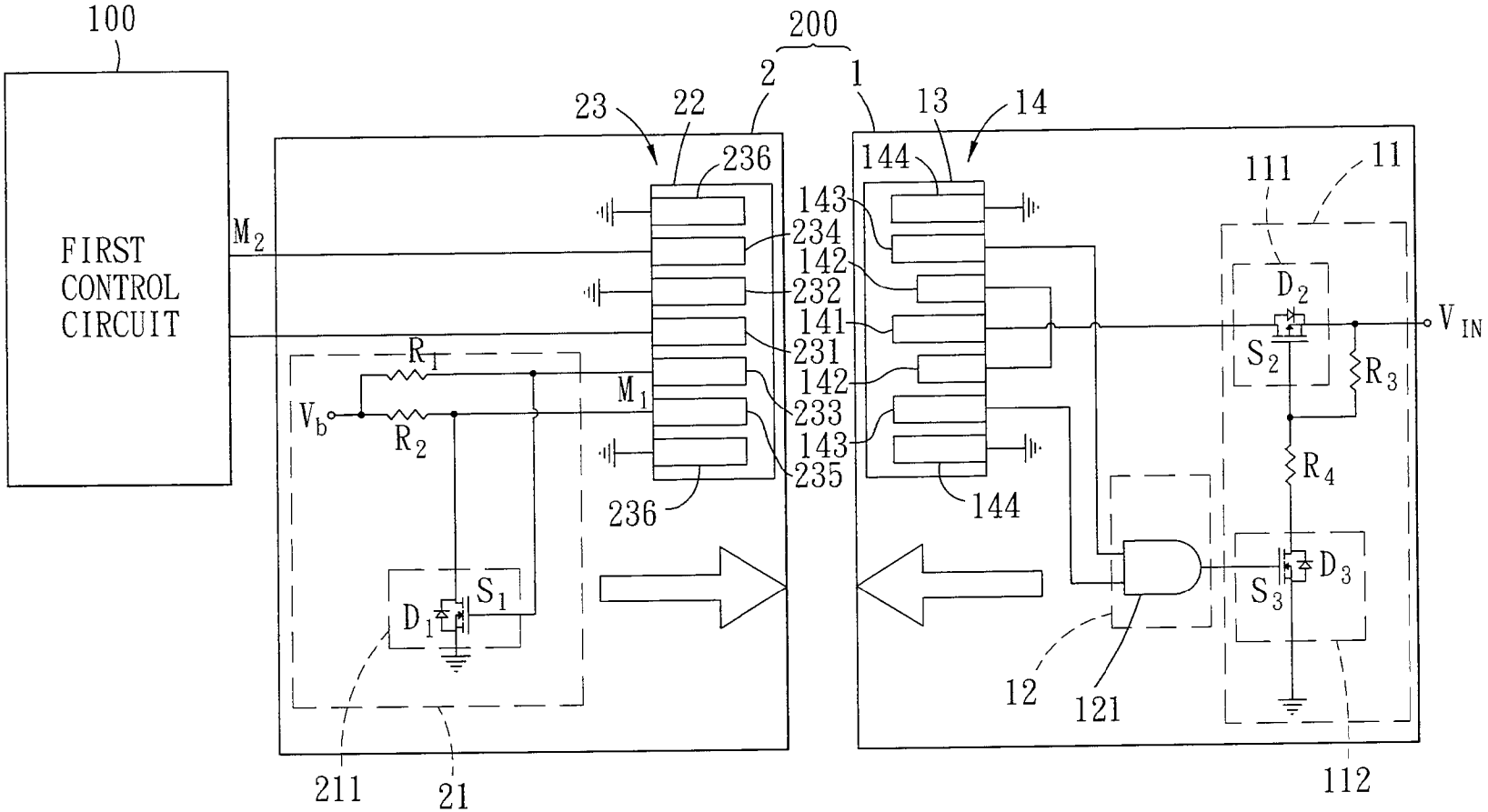
FIG. 2 is a circuit diagram of the electrical device.

FIGS. 1 and 2 show an electronic device according to the first preferred embodiment of the present invention. The electronic device is adapted to receive an electrical power signal $V_{IN}$, and includes a first control circuit 100 and an electrical connector assembly 200. The electrical connector assembly 200 includes a first connector 1 and a second connector 2 able to connect to each other. In this embodiment, the electronic device is a laptop computer, and the first control circuit 100 and the second connector 2 are disposed on a body (not shown) of the electronic device and are electronically coupled to each other. The electrical power signal $V_{IN}$ is obtained through an adaptor (not shown) which converts a commercial alternating current (AC) power to a direct current (DC) power signal.

The first connector 1 includes a switch unit 11, a second control circuit 12, a first substrate 13 and a first contact unit 14. The first contact unit 14 is disposed on the first substrate 13 and includes a first electrical power contact pad 141, and two first detecting contact pads 142, two first control contact pads 143 and two first grounding contact pads 144 symmetrically arranged on opposite sides of the first electrical power contact pad 141. In this embodiment, the first detecting contact pads 142, the first control contact pads 143 and the first grounding contact pads 144 are arranged in sequence, but the order of arrangement is not restricted to this configuration.

The first detecting contact pads 142 are electrically connected to each other. The first grounding contact pads 144 are grounded. The second control circuit 12 is electrically coupled to the first control contact pads 143. The switch unit 11 has a first terminal adapted for receiving the electrical power signal $V_{IN}$, a second terminal connected electrically to the first electrical power contact pad 141, and a control terminal electrically connected to the second control circuit 12. The switch unit 11 is controlled by the second control circuit 12 to switch between a conducting state and a non-conducting state.

In this embodiment, the second control circuit 12 includes an AND gate 121 that has two input terminals respectively and electrically connected to the first control contact pads 143, and an output terminal electrically connected to the control terminal of the switch unit 11.

The second connector 2 includes a detecting circuit 21, a second substrate 22 and a second contact unit 23. The second contact unit 23 is disposed on the second substrate 22 and includes a second electrical power contact pad 231, a second detecting contact pad 232 and a third detecting contact pad 233 symmetrically arranged on opposite sides of the second electrical power contact pad 231, a second control contact pad 234 and a third control contact pad 235 symmetrically arranged on the opposite sides of the second electrical power contact pad 231, and two second grounding contact pads 236 symmetrically arranged on the opposite sides of the second electrical power contact pad 231. In this embodiment, the second and third detecting contact pads 232, 233, the second and third control contact pads 234, 235, and the second grounding contact pads 236 are arranged in sequence on the two sides to correspond to the first contact unit 14.

The second detecting contact pad 232 is to receive a trigger signal. The second grounding contact pads 236 are grounded. The second electrical power contact pad 231 and the second control contact pad 234 are electrically connected to the first control circuit 100. The detecting circuit 21 is electrically connected to the third detecting contact pad 233 and the third control contact pad 235. In this embodiment, the trigger signal is a ground signal (i.e., the second detecting contact pad 232 is grounded). The detecting circuit 21 includes a first switch 211, a first resistor $R_1$ and a second resistor $R_2$. The first resistor $R_1$ has a first terminal that is adapted for receiving a biasing voltage $V_b$ and a second terminal that is electrically connected to the third detecting contact pad 233. The second resistor $R_2$ has a first terminal that is electrically connected to the first terminal of the first resistor $R_1$ and a second terminal that is electrically connected to third control contact pad 235.

The first switch 211 has a first terminal that is electrically connected to the second terminal of the second resistor $R_2$, a second terminal that is grounded, and a control terminal that is electrically connected to the second terminal of the first resistor $R_1$. More specifically, the first switch 211 includes a first transistor $S_1$ and a first diode $D_1$. The first transistor is an NMOS transistor and has a drain, a source and a gate that are respectively and electrically connected to the first, second and control terminals of the first switch 211. The first diode $D_1$ has an anode and a cathode that are respectively and electrically connected to the second and first terminals of the first switch 211.

The switch unit 11 includes a second switch 111, a third switch 112, a third resistor $R_3$ and a fourth resistor $R_4$. The third resistor $R_3$ has a first terminal that is electrically connected to the first terminal of the switch unit 11 and that is adapted for receiving the electrical power signal $V_{IN}$, and a second terminal. The fourth resistor $R_4$ has a first terminal that is electrically connected to the second terminal of the third resistor $R_3$, and a second terminal. The second switch 111 has a first terminal that is electrically connected to the second terminal of the switch unit 11, a second terminal that is electrically connected to the first terminal of the switch unit 11 and a control terminal that is electrically connected to the second terminal of the third resistor $R_3$. The third switch 112 has a first terminal that is electrically connected to the second terminal of the fourth resistor $R_4$, a second terminal that is grounded, and a control terminal that is electrically connected to the control terminal of the switch unit 11.

More specifically, the second switch 111 includes a second transistor $S_2$ and a second diode $D_2$. The second transistor $S_2$ is a PMOS transistor and has a drain, a source and a gate that are respectively and electrically connected to the first, second and control terminals of the second switch 111. The second diode $D_2$ has an anode and a cathode that are respectively and electrically connected to the first and second terminals of the second switch 111. The third switch 112 includes a third transistor $S_3$ and a third diode $D_2$. The third transistor $S_3$ is an NMOS transistor and has a drain, a source and a gate that are respectively and electrically connected to the first, second and control terminals of the third switch 112. The third diode $D_3$ has an anode and a cathode that are respectively and electrically connected to the second and first terminals of the third switch 112.

It is worth mentioning that one of the first, second and third detecting contact pads 142, 232, 233 has a length that is smaller than that of the first and second electrical power contact pads 141, 231, the first, second and third control contact pads 143, 234, 235 and the first and second grounding contact pads 144, 236. In this embodiment, the first detecting contact pads 142 has a length smaller than that of the rest of the contact pads 141, 143, 144, 231~236 of equal length. The effects of this length difference in the contact pads 141~144, 231~236 would be described in detail later in the text.

When the first and second connectors 1, 2 are not connected together, the input terminals of the AND gate 121 are open circuited such that the output terminal of the ANG gate 121 outputs a low electrical potential to cut off the third transistor $S_3$ and, in turn, cutting off the second transistor $S_2$. Moreover, the gate of the first transistor $S_1$ receives the biasing voltage $V_b$ such that the first transistor $S_1$ is conducting (i.e., the first and second terminals of the first switch 211 conduct), putting the third control contact pad 235 at a low electrical potential.

In a process of connecting the first connector 1 and the second connector 2, due to the length difference in the contact pads 141~144, 231~236, the electrical connector assembly 200 is disposed sequentially in a first state and a second state. The first state is a transient state during the connecting process. In the first state, the first electrical power contact pad 141 is in electrical contact with the second electrical power contact pad 231, the first grounding contact pads 144 are respectively in electrical contact with the second grounding contact pads 236, and the first control contact pads 143 are respectively in electrical contact with the second and third control contact pads 234, 235, such that the AND gate 121 of the second control circuit 12 is electrically connected to the first control circuit 100 and the detecting circuit 21. When the electrical connector assembly 200 is in the first state, the first and second terminals of the first switch 211 are conducting such that the third control contact pad 235 stays at a low electrical potential. Since one of the input terminals of the AND gate 121 receives the low electrical potential of the third control contact pad 235, the output terminal of the AND gate 121 maintains at the low electrical potential such that the second and third transistors $S_2$, $S_3$ remain in the cut-off state. In other words, the first and second terminals of the second and third switches 111, 112 remain non-conducting. Since the first detecting contact pads 142 are shorter in length, the first detecting contact pads 142 are not in electrical contact with the second and third detecting contact pads 232, 233 in the first state.

In the second state, the first connector land second connector 2 are fully connected, where the first electrical power contact pad 141 remains in electrical contact with the second electrical power contact pad 231, the first grounding contact pads 144 respectively remain in electrical contact with the second grounding contact pads 236, and the first control contact pads 143 respectively remain in electrical contact with the second and third control contact pads 233, 234 such that the second control circuit 12 remains electrically connected to the first control circuit 100 and the detecting circuit 21. In addition, the first detecting contact pads 142 are respectively in electrical contact with the second and third detecting contact pads 232, 233, such that the second detecting contact pad 232, the first detecting contact pads 142 and the third detecting contact pad 233 form a circuit loop and that the trigger signal is transmitted from the second detecting contact pad 232 through the loop to the detecting circuit 21. The detecting circuit 21 generates a detecting signal $M_1$ based on the trigger signal and transmit the detecting signal $M_1$ to the second control circuit 12 through the electrical contact between the third control contact pad 235 and a respective one of the first control contact pads 143. More specifically, the gate of the first transistor $S_1$ receives the trigger signal such that the first transistor $S_1$ enters the cut-off state (i.e., the first and second terminal of the first switch 211 are non-conducting) and that the first terminal of the first switch 211 is at a high electrical potential, that is, the detecting signal $M_1$ is generated. Said one of the input terminals of the AND gate 121 receives the detecting signal $M_1$ and is at a high electrical potential.

When the electrical connector assembly 200 is in the second state, and when the first control circuit 100 generates a high electrical potential control signal $M_2$, the second control circuit 12 controls the switch unit 11 to conduct according to the control signal $M_2$ and the detecting signal $M_1$, such that the electrical power signal $V_{IN}$ can be transmitted to the first control circuit 100. More specifically, with said one of the input terminals of the AND gate 121 at the high electrical potential for receiving the detecting signal $M_1$, the control signal $M_2$ putting the other of the input terminals of the AND gate 121 of the second control circuit 12 at the high electrical potential makes the AND gate 121 output a high electrical potential at the output terminal thereof, in turn, making the third and second transistors $S_3$, $S_2$ conducting (i.e., the first and second terminals of the second and third switches 111, 112 conduct, i.e., the first and second terminals of the switch unit 11 conduct) to provide the electrical power signal $V_{IN}$ to the first control circuit 100 via the switch unit 11, the first electrical power contact pad 141 and the second electrical power contact pad 231. From the above, the first control circuit 100 can decide the timing to receive the electrical power signal $V_{IN}$ when the electrical connector assembly 200 is in the second state to prevent malfunctions or short circuits. Moreover, by having the detecting circuit 21 in the design, the electrical connector assembly 200 requires the first and second connectors 1, 2 in full contact in order to transmit the electrical power signal $V_{IN}$, thereby preventing transmission of the electrical power signal $V_{IN}$ before the first grounding contact pads 144 and the second grounding contact pads 236 are in full electrical contacts.

In addition, by having the symmetrical design of the first and second contact units 14, 23, whether the user tries to connect the first and second connectors 1, 2 together in an upright position or in an upside-down position (when the first connector 1 is rotated at 180 degrees with respect to an axis of the first electrical power contact pad 141), the first and second contact units 14, 23 are still operable so as to prevent short circuits of the first control circuit 100 when the user connects the first and second connectors 1, 2 incorrectly.

Figure 3:
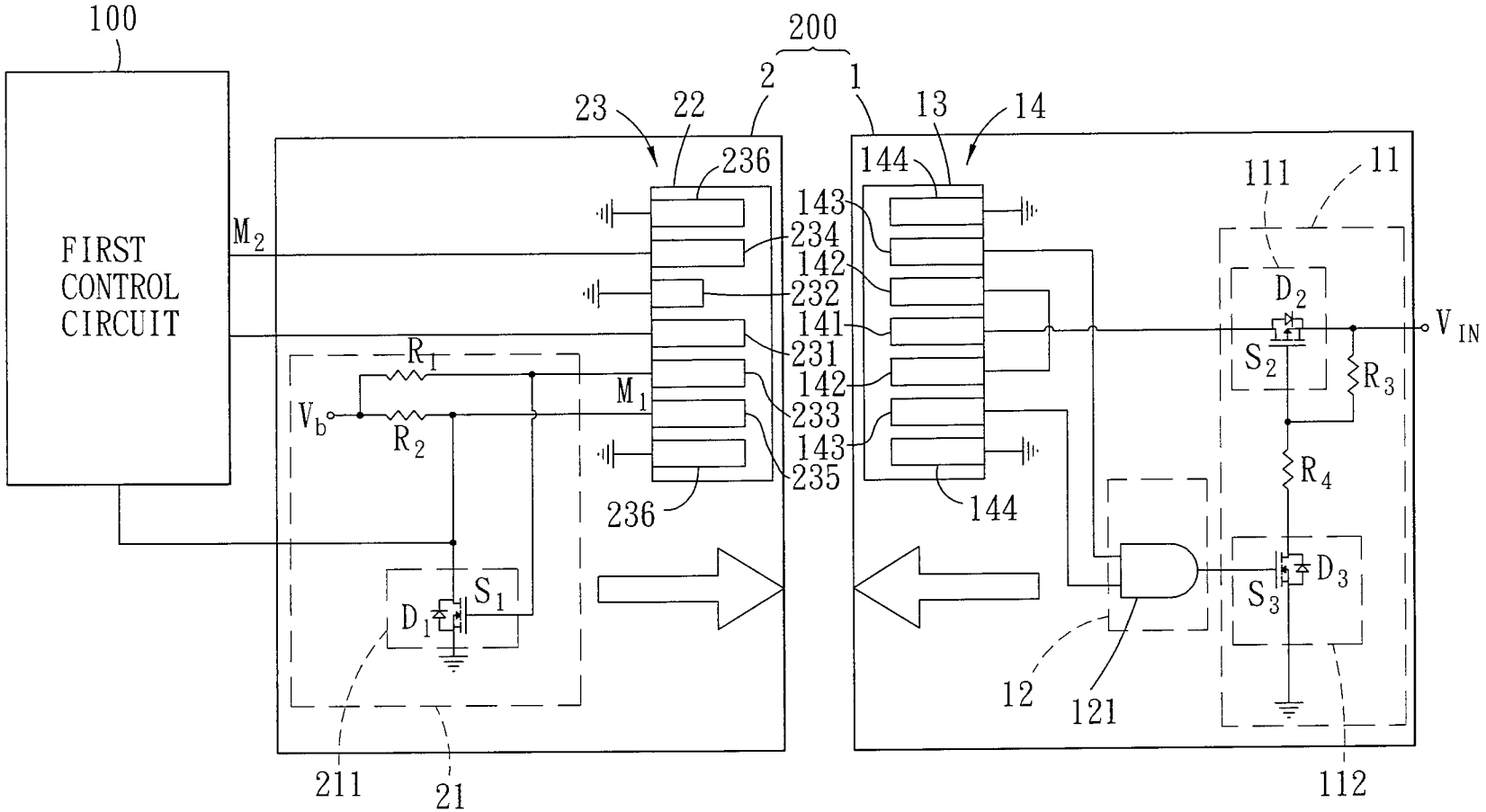
FIG. 3 is a circuit diagram of an electrical device according to the second preferred embodiment of the present invention.

FIG. 3 shows an electronic device according to the second preferred embodiment of the present invention. The second preferred embodiment is similar to the first preferred embodiment with the difference being described below. In the second preferred embodiment, the first control circuit 100 is further electrically connected to the first terminal of the first switch 211 of the detecting circuit 21 for receiving the detecting signal $M_1$ so as to generate the control signal $M_2$ according to the detecting signal $M_1$.

Moreover, only the second detecting contact pad 232 of the second contact unit 23 is shorter than the rest of the contact pads 141~144, 231, 233~236. Similar to the first preferred embodiment, the trigger signal is only provided to the detecting circuit 21 after a circuit loop is formed by the second detecting contact pad 232, the first detecting contact pads 142 and the third detecting contact pad 233 when the first connector 1 and the second connector 2 are fully connected, i.e., in the second state.

Therefore, with the first and second connectors 1, 2 designed in the manner according to the present invention, the electrical connector assembly 200 only begins to transmit the electrical power signal $V_{IN}$ to the first control circuit 100 under the condition that each contact pad of the first contact unit 14 is electrically contacted with a respective contact pad of the second contact unit 23, and that the first control circuit 100 transmits the control signal $M_2$, so that the first control circuit 100 is prevented from malfunctioning or short circuiting. Moreover, by having the symmetrical design in the contact pins of the first and second contact units 14, 23, the first and second connectors 1, 2 may be connected together in an upright position or in an upside-down position, preventing the drawback of short circuiting the first control circuit 100 when a user connects the first and second connectors 1, 2 improperly.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electronic device adapted for receiving an electrical power signal, comprising:

a first control circuit capable of generating a control signal; and an electrical connector assembly including a first connector that includes a switch unit, a second control circuit, a first substrate and a first contact unit, said first connector unit being disposed on said first substrate and including a first electrical power contact pad, and two first detecting contact pads, two first control contact pads and two first grounding contact pads symmetrically arranged on opposite sides of said first electrical power contact pad, said first detecting contact pads being electrically connected to each other, said first grounding contact pads being grounded, said second control circuit being electrically connected to said first control contact pads, said switch unit having a first terminal adapted for receiving the electrical power signal, a second terminal connected electrically to said first electrical power contact pad, and a control terminal electrically connected to said second control circuit, said switch unit being controlled by said second control circuit to switch between a conducting state, where said first and second terminals are conducting, and a non-conducting state, where said first and second terminals are not-conducting; and a second connector that includes a detecting circuit, a second substrate and a second contact unit, said second contact unit being disposed on said second substrate and including a second electrical power contact pad, a second detecting contact pad and a third detecting contact pad symmetrically arranged on opposite sides of said second electrical power contact pad, a second control contact pad and a third control contact pad symmetrically arranged on said opposite sides of said second electrical power contact pad, and two second grounding contact pads symmetrically arranged on said opposite sides of said second electrical power contact pad, said second detecting contact pad receiving a trigger signal, said second grounding contact pads being grounded, said second electrical power contact pad and said second control contact pad being electrically connected to said first control circuit, said detecting circuit being electrically connected to said third detecting contact pad and said third control contact pad;

wherein in a process of connecting said first connector and said second connector, said electrical connector assembly is disposed sequentially in a first state and a second state;

wherein in the first state, said first electrical power contact pad is in electrical contact with said second electrical power contact pad, said first grounding contact pads are respectively in electrical contact with said second grounding contact pads, and said first control contact pads are respectively in electrical contact with said second and third control contact pads, such that said second control circuit is electrically connected to said first control circuit and said detecting circuit;

wherein in the second state, said first electrical power contact pad remains in electrical contact with said second electrical power contact pad, said first grounding contact pads respectively remain in electrical contact with said second grounding contact pads, and said first control contact pads respectively remain in electrical contact with said second and third control contact pads such that said second control circuit remains electrically connected to said first control circuit and said detecting circuit, and said second detecting contact pad forms a circuit loop with said first detecting contact pads and said third detecting contact pad such that the trigger signal is transmitted from said second detecting contact pad through the loop to said detecting circuit for said detecting circuit to generate a detecting signal based on the trigger signal and transmit the detecting signal to said second control circuit through the electrical contact between said third control contact pad and a respective one of said first control contact pads; and wherein when said electrical connector assembly is in the second state, and when said first control circuit generates the control signal, said second control signal receives the control signal from said first control circuit through the electrical contact between said second control contact pad and a respective one of said first control contact pads, and controls said switch unit to switch from the non-conducting state to the conducting state based on the control signal and the detecting signal, wherein when said switch unit is in the conducting state, the electrical power signal is transmitted to said first control circuit through the electrical contact between said first and second electrical power contact pads.

2. The electronic device as claimed in claim 1, wherein the trigger signal is a ground signal, said detecting circuit including a first switch, a first resistor and a second resistor, said first resistor having a first terminal that is adapted for receiving a biasing voltage and a second terminal that is electrically connected to said third detecting contact pad, said second resistor having a first terminal that is electrically connected to said first terminal of said first resistor and a second terminal that is electrically connected to third control contact pad, said first switch having a first terminal that is electrically connected to said second terminal of said second resistor, a second terminal that is grounded, and a control terminal that is electrically connected to said second terminal of said first resistor;

wherein, when said electrical connector assembly is in the first state, said first and second terminals of said first switch being conducting;

wherein, when said electrical connector assembly is in the second state, said first and second terminals of said first switch being non-conducting, and the detecting signal is generated at said first terminal of said first switch.

3. The electronic device as claimed in claim 2, wherein said switch unit includes a second switch, a third switch, a third resistor and a fourth resistor, said third resistor having a first terminal that is electrically connected to said first terminal of said switch unit, and a second terminal, said fourth resistor having a first terminal that is electrically connected to said second terminal of said third resistor, and a second terminal, said second switch having a first terminal that is electrically connected to said second terminal of said switch unit, a second terminal that is electrically connected to said first terminal of said switch unit and a control terminal that is electrically connected to said second terminal of said third resistor, said third switch having a first terminal that is electrically connected to said second terminal of said fourth resistor, a second terminal that is grounded, and a control terminal that is electrically connected to said control terminal of said switch unit;

wherein when said electrical connector assembly is in the first state, said first and second terminal of each of said second and third switches are non-conducting; and wherein when said switch unit is in the conducting state, said first and second terminals of each of said second and third switches are conducting, such that the electrical power signal is transmitted to said first control circuit when said electrical connector assembly is in the second state and when said first control circuit generates the control signal.

4. The electronic device as claimed in claim 3, wherein said second control circuit includes an AND gate that has two input terminals respectively and electrically connected to said first control contact pads, and an output terminal electrically connected to said control terminal of said switch unit.

5. The electronic device as claimed in claim 4, wherein said first control circuit is further connected electrically to said detecting circuit for receiving the detecting signal therefrom.

6. The electronic device as claimed in claim 4, wherein one of said first, second and third detecting contact pads has a length that is smaller than that of said first and second electrical power contact pads, said first, second and third control contact pads and said first and second grounding contact pads.

7. The electronic device as claimed in claim 4, wherein said first switch includes a first transistor and a first diode, said first transistor having a drain, a source and a gate that are respectively and electrically connected to said first, second and control terminals of said first switch, said first diode having an anode and a cathode that are respectively and electrically connected to said second and first terminals of said first switch;

wherein said second switch includes a second transistor and a second diode, said second transistor having a drain, a source and a gate that are respectively and electrically connected to said first, second and control terminals of said second switch, said second diode having an anode and a cathode that are respectively and electrically connected to said first and second terminals of said second switch;

wherein said third switch includes a third transistor and a third diode, said third transistor having a drain, a source and a gate that are respectively and electrically connected to said first, second and control terminals of said third switch, said third diode having an anode and a cathode that are respectively and electrically connected to said second and first terminals of said third switch.

8. An electrical connector assembly adapted for receiving an electrical power signal and transmitting the electrical power signal to a first control circuit, said electrical connector assembly comprising:

a first connector that includes a switch unit, a second control circuit, a first substrate and a first contact unit, said first connector unit being disposed on said first substrate and including a first electrical power contact pad, and two first detecting contact pads, two first control contact pads and two first grounding contact pads symmetrically arranged on opposite sides of said first electrical power contact pad, said first detecting contact pads being electrically connected to each other, said first grounding contact pads being grounded, said second control circuit being electrically connected to said first control contact pads, said switch unit having a first terminal adapted for receiving the electrical power signal, a second terminal connected electrically to said first electrical power contact pad, and a control terminal electrically connected to said second control circuit, said switch unit being controlled by said second control circuit to switch between a conducting state, where said first and second terminals are conducting, and a non-conducting state, where said first and second terminals are not-conducting; and a second connector that includes a detecting circuit, a second substrate and a second contact unit, said second contact unit being disposed on said second substrate and including a second electrical power contact pad, a second detecting contact pad and a third detecting contact pad symmetrically arranged on opposite sides of said second electrical power contact pad, a second control contact pad and a third control contact pad symmetrically arranged on said opposite sides of said second electrical power contact pad, and two second grounding contact pads symmetrically arranged on said opposite sides of said second electrical power contact pad, said second detecting contact pad receiving a trigger signal, said second grounding contact pads being grounded, said second electrical power contact pad and said second control contact pad being adapted to be electrically connected to the first control circuit, said detecting circuit being electrically connected to said third detecting contact pad and said third control contact pad;

wherein in a process of connecting said first connector and said second connector, said electrical connector assembly is disposed sequentially in a first state and a second state;

wherein in the first state, said first electrical power contact pad is in electrical contact with said second electrical power contact pad, said first grounding contact pads are respectively in electrical contact with said second grounding contact pads, and said first control contact pads are respectively in electrical contact with said second and third control contact pads, such that said second control circuit is electrically connected to the first control circuit and said detecting circuit;

wherein in the second state, said first electrical power contact pad remains in electrical contact with said second electrical power contact pad, said first grounding contact pads respectively remain in electrical contact with said second grounding contact pads, and said first control contact pads respectively remain in electrical contact with said second and third control contact pads such that said second control circuit remains electrically connected to the first control circuit and said detecting circuit, and said second detecting contact pad forms a circuit loop with said first detecting contact pads and said third detecting contact pad such that the trigger signal is transmitted from said second detecting contact pad through the loop to said detecting circuit for said detecting circuit to generate a detecting signal based on the trigger signal and transmit the detecting signal to said second control circuit through the electrical contact between said third control contact pad and a respective one of said first control contact pads; and wherein when said electrical connector assembly is in the second state, and when the first control circuit generates a control signal, said second control signal receives the control signal from the first control circuit through the electrical contact between said second control contact pad and a respective one of said first control contact pads, and controls said switch unit to switch from the non-conducting state to the conducting state based on the control signal and the detecting signal, wherein when said switch unit is in the conducting state, the electrical power signal is transmitted to the first control circuit through the electrical contact between said first and second electrical power contact pads.

9. The electrical connector assembly as claimed in claim 8, wherein the trigger signal is a ground signal, said detecting circuit including a first switch, a first resistor and a second resistor, said first resistor having a first terminal that is adapted for receiving a biasing voltage and a second terminal that is electrically connected to said third detecting contact pad, said second resistor having a first terminal that is electrically connected to said first terminal of said first resistor and a second terminal that is electrically connected to third control contact pad, said first switch having a first terminal that is electrically connected to said second terminal of said second resistor, a second terminal that is grounded, and a control terminal that is electrically connected to said second terminal of said first resistor;

wherein, when said electrical connector assembly is in the first state, said first and second terminals of said first switch being conducting;

wherein, when said electrical connector assembly is in the second state, said first and second terminals of said first switch being non-conducting, and the detecting signal is generated at said first terminal of said first switch.

10. The electrical connector assembly as claimed in claim 9, wherein said switch unit includes a second switch, a third switch, a third resistor and a fourth resistor, said third resistor having a first terminal that is electrically connected to said first terminal of said switch unit, and a second terminal, said fourth resistor having a first terminal that is electrically connected to said second terminal of said third resistor, and a second terminal, said second switch having a first terminal that is electrically connected to said second terminal of said switch unit, a second terminal that is electrically connected to said first terminal of said switch unit and a control terminal that is electrically connected to said second terminal of said third resistor, said third switch having a first terminal that is electrically connected to said second terminal of said fourth resistor, a second terminal that is grounded, and a control terminal that is electrically connected to said control terminal of said switch unit;

wherein when said electrical connector assembly is in the first state, said first and second terminal of each of said second and third switches are non-conducting; and wherein when said switch unit is in the conducting state, said first and second terminals of each of said second and third switches are conducting, such that the electrical power signal is transmitted to the first control circuit when said electrical connector assembly is in the second state and when said first control circuit generates the control signal.

11. The electrical connector assembly as claimed in claim 10, wherein said second control circuit includes an AND gate that has two input terminals respectively and electrically connected to said first control contact pads, and an output terminal electrically connected to said control terminal of said switch unit.

12. The electronic device as claimed in claim 11, wherein one of said first, second and third detecting contact pads has a length that is smaller than that of said first and second electrical power contact pads, said first, second and third control contact pads and said first and second grounding contact pads.

13. The electrical connector assembly as claimed in claim 11, wherein said first switch includes a first transistor and a first diode, said first transistor having a drain, a source and a gate that are respectively and electrically connected to said first, second and control terminals of said first switch, said first diode having an anode and a cathode that are respectively and electrically connected to said second and first terminals of said first switch;

wherein said second switch includes a second transistor and a second diode, said second transistor having a drain, a source and a gate that are respectively and electrically connected to said first, second and control terminals of said second switch, said second diode having an anode and a cathode that are respectively and electrically connected to said first and second terminals of said second switch;

wherein said third switch includes a third transistor and a third diode, said third transistor having a drain, a source and a gate that are respectively and electrically connected to said first, second and control terminals of said second switch, said third diode having an anode and a cathode that are respectively and electrically connected to said second and first terminals of said third switch.

* * * * *